US012295401B2

(12) United States Patent
Mathie et al.

(10) Patent No.: US 12,295,401 B2
(45) Date of Patent: May 13, 2025

(54) AEROSOLISABLE FORMULATION

(71) Applicant: NICOVENTURES TRADING LIMITED, London (GB)

(72) Inventors: Klaus Mathie, London (GB); Maria Montserrat Sanchez Pena, London (GB)

(73) Assignee: NICOVENTURES TRADING LIMITED, London (GB)

( * ) Notice: Subject to any disclaimer, the term of this patent is extended or adjusted under 35 U.S.C. 154(b) by 1104 days.

(21) Appl. No.: 17/261,197

(22) PCT Filed: Jul. 18, 2019

(86) PCT No.: PCT/GB2019/052008
§ 371 (c)(1),
(2) Date: Jan. 19, 2021

(87) PCT Pub. No.: WO2020/016586
PCT Pub. Date: Jan. 23, 2020

(65) Prior Publication Data

US 2021/0267262 A1 Sep. 2, 2021

(30) Foreign Application Priority Data

Jul. 20, 2018 (GB) ..... 1811926

(51) Int. Cl.

| | |
|---|---|
| ***A24B 15/167*** | (2020.01) |
| ***A24B 15/24*** | (2006.01) |
| ***A24B 15/30*** | (2006.01) |
| ***A24F 40/10*** | (2020.01) |
| ***A24F 40/42*** | (2020.01) |

(52) U.S. Cl.
CPC ..... *A24B 15/167* (2016.11); *A24B 15/243* (2013.01); *A24B 15/30* (2013.01); *A24F 40/10* (2020.01); *A24F 40/42* (2020.01)

(58) Field of Classification Search
CPC ..... A24B 15/167; A24F 40/10; A24F 40/42; A24F 40/30
See application file for complete search history.

(56) References Cited

U.S. PATENT DOCUMENTS

| | | | | |
|---|---|---|---|---|
| 4,888,189 | A | 12/1989 | Gnekow | |
| 4,999,209 | A | 3/1991 | Gnekow | |
| 2007/0202051 | A1 | 8/2007 | Schuschnig | |
| 2013/0152956 | A1* | 6/2013 | von Borstel | A24B 15/16 131/329 |
| 2014/0209109 | A1* | 7/2014 | Larson | A61K 31/352 131/329 |
| 2015/0196060 | A1* | 7/2015 | Wensley | A61M 15/002 392/404 |
| 2016/0309775 | A1 | 10/2016 | Parker | |
| 2016/0353795 | A1* | 12/2016 | Kobal | A24F 23/02 |
| 2017/0086500 | A1 | 3/2017 | Li et al. | |
| 2017/0112197 | A1 | 4/2017 | Li et al. | |

FOREIGN PATENT DOCUMENTS

| | | | |
|---|---|---|---|
| CA | 2780344 | | 5/2001 |
| CN | 104125782 | A | 10/2014 |
| CN | 104585862 | A | 5/2015 |
| CN | 104824835 | | 8/2015 |
| CN | 105011351 | | 11/2015 |
| CN | 105455190 | A | 4/2016 |
| CN | 106136299 | | 11/2016 |
| CN | 107846963 | A | 3/2018 |
| EP | 0690124 | | 1/1996 |
| EP | 0691083 | A1 | 1/1996 |
| JP | 35-018437 | B | 12/1960 |
| JP | 2008048691 | A | 3/2008 |
| RU | 2489948 | C2 | 8/2013 |
| RU | 2764269 | C1 | 1/2022 |
| WO | WO1984003102 | | 8/1984 |
| WO | 2008099325 | A1 | 8/2008 |
| WO | 2013090410 | A1 | 6/2013 |
| WO | WO2013088230 | | 6/2013 |
| WO | 2013103318 | A1 | 7/2013 |
| WO | WO2014125340 | | 8/2014 |
| WO | WO2015084544 | | 6/2015 |
| WO | WO2016069876 | | 5/2016 |
| WO | WO2016071705 | | 5/2016 |

(Continued)

OTHER PUBLICATIONS

International Search Report and Written Opinion for PCT/GB2019/052008 date mailed Oct. 11, 2019.
Winefolly, "The Surprising Potential of Non-Alcoholic Wine", Oct. 17, 2014. http://winefolly.com/tutorial/non-alcoholic-wine/.
Veppo Vape Shop, "Rum Flavor E-liquid Nicotine", Apr. 10, 2018. https://veppocig.com/rum-flavor-e-liquid-nicotine-10ml.
Jackler et al., "Alcohol-flavoured Tobacco Products", Jul. 5, 2017. http://scihub.tw/http:/tobaccocontrol.bmj.com/content/early/2017/08/22/tobaccocontrol-2016-053609.

(Continued)

*Primary Examiner* — Michael H. Wilson
*Assistant Examiner* — Stephanie Lynn Moore
(74) *Attorney, Agent, or Firm* — Womble Bond Dickinson (US) LLP; Mark R. DeLuca

(57) ABSTRACT

An aerosolizable formulation having one or more aerosol-forming agents and a flavoring agent being an extract obtained from an alcoholic beverage, and wherein the extract contains less than about 5% v/v ethanol. A process for forming an aerosolizable formulation, forming an aerosol from the aerosolizable formulation, a contained aerosolizable formulation, an electronic aerosol provision system and the use of an extract obtained from an alcoholic beverage as a flavoring agent in an electronic aerosol provision system, wherein the extract contains less than about 5% v/v ethanol.

21 Claims, No Drawings

(56) References Cited

FOREIGN PATENT DOCUMENTS

WO 2018/087165 A1 5/2018

OTHER PUBLICATIONS

Veppo Vape Shop, "What is E-juice or Vape juice?", Apr. 10, 2018.
https://veppocig.com/vape-juice-or-e-juice.
Ukraine Office Action dated Mar. 21, 2024.

* cited by examiner

AEROSOLISABLE FORMULATION

PRIORITY CLAIM

The present application is a National Phase entry of PCT Application No. PCT/GB2019/052008, filed Jul. 18, 2019 which claims priority from GB Patent Application No. 1811926.3 filed Jul. 20, 2018, each of which is hereby fully incorporated herein by reference.

FIELD OF THE INVENTION

The present disclosure relates to an aerosolizable formulation, to containers in which are contained the aerosolizable formulation and to electronic aerosol provision systems such as electronic aerosol delivery systems (e.g. e-cigarettes) incorporating said formulation.

BACKGROUND TO THE INVENTION

Electronic aerosol delivery systems such as e-cigarettes generally contain a reservoir of liquid which is to be turned into an aerosol, typically containing nicotine. When a user inhales on the device, a heater is activated to aerosolize or vaporize a small amount of liquid, which is inhaled by the user. The liquid for e-cigarettes may also contain a flavor component to provide a sensory experience to the user. In some circumstances, the liquid may contain a flavor component without nicotine.

Amongst the flavor components available to users are alcoholic flavors such as wine, beer, spirits, liqueurs and mixed drinks (e.g. cocktails). When used in a nicotine-containing liquid, these alcoholic flavors can provide the user with a unique sensory experience. However, the alcoholic flavors currently available to users tend to be artificial flavors and/or can include significant amounts of ethanol. This is problematic because these features result in poor flavor quality, an unnatural sensory experience and reduced consumer satisfaction.

SUMMARY OF THE INVENTION

In one aspect there is provided an aerosolizable formulation comprising:

(i) one or more aerosol-forming agents; and (ii) a flavoring agent, wherein the flavoring agent is an extract obtained from an alcoholic beverage, and wherein the extract contains less than about 5% v/v ethanol.

The present invention further provides a process for forming an aerosol, the process comprising: providing an aerosolizable formulation as defined herein, and aerosolizing the formulation. Also provided by the present invention is a contained aerosolizable formulation comprising: a container, and an aerosolizable formulation as defined herein.

The present invention further provides an electronic aerosol provision system comprising (i) an aerosolizer for aerosolizing liquid for inhalation by a user of the electronic aerosol provision system, (ii) a power supply comprising a cell or battery for supplying power to the aerosolizer; and (iii) an aerosolizable formulation as defined herein.

The present invention further provides the use of an extract obtained from an alcoholic beverage and containing less than 5% v/v ethanol, as a flavoring agent in an electronic aerosol provision system (e.g. an e-cigarette). In one embodiment the aerosolizable formulation is the formulation defined herein.

DETAILED DESCRIPTION

As discussed herein, the present invention provides an aerosolizable formulation comprising (i) one or more aerosol-forming agents, and (ii) a flavoring agent, wherein the flavoring agent is an extract obtained from an alcoholic beverage, and wherein the extract contains less than about 5% v/v ethanol.

Agents aimed at replicating the flavor of an alcoholic beverage are documented in the art. They are, for example used in the food industry and have also been used in the tobacco product industry. Such flavoring agents are not, however, an extract obtained from an alcoholic beverage as in the present invention, and can include significant amounts of ethanol. This means that the known flavoring agents provide an artificial aroma and flavor when inhaled by the user and are of low quality in terms of the sensory experience they provide.

We have found that, by incorporating a flavoring agent which is an extract obtained from an alcoholic beverage and which contains less than about 5% v/v ethanol, an aerosolizable formulation is provided which retains the flavor of the original alcoholic beverage but without the inclusion of significant amounts of ethanol. Advantageously, such formulations improve consumer satisfaction by improving the flavor quality when the formulation is aerosolized and the sensory experience of the user inhaling the aerosol.

For ease of reference, these and further aspects of the present invention are now discussed under appropriate section headings. As will be understood by the skilled person, the teachings of each section are not limited to the section in question, but may be combined with other sections as appropriate.

Flavoring Agent

As discussed herein, the aerosolizable formulation of the present invention comprises a flavoring agent which is an extract obtained from an alcoholic beverage. The term "flavoring agent" may be used interchangeably with "flavor" or "flavorant", and these terms refer to materials which, where local regulations permit, are added to a formulation to create a desired taste or aroma in a product for adult consumers. Reference here to "flavoring agent", "flavor" or "flavorant" includes both singular and multi-component flavors.

By the expression "extract obtained from an alcoholic beverage" is meant a product or substance obtained from an extraction or separation process involving an alcoholic beverage. The extract may be in any suitable form, for example, oil, liquid or powder. In one aspect the extract is a liquid extract.

Extraction or separation processes are known to the person skilled in the art and the present invention is not limited in this respect. The extract included in the aerosolizable formulation of the present invention may therefore be obtained via any extraction or separation process known in the art.

One process which is known in the art to be useful for extracting compounds from an alcoholic beverage is reverse osmosis. Reverse osmosis is a process by which a solvent passes through a porous membrane in the direction opposite to that for natural osmosis, when subjected to a hydrostatic pressure greater than the osmotic pressure. In the context of alcoholic beverages, the flavor and aroma compounds are typically filtered out of the beverage (e.g. wine) by reverse osmosis through a semi-permeable membrane. Water and ethanol are able to pass through the membrane, whilst the flavor and aroma compounds cannot. The water/ethanol mixture is then distilled to extract the ethanol and the resulting water is recombined with the flavor and aroma compounds to provide an extract having reduced ethanol content.

In one aspect the extract included in the aerosolizable formulation of the present invention is therefore obtained via reverse osmosis. Suitable extraction processes involving reverse osmosis are described, for example, in U.S. Pat. Nos. 4,999,209, 4,888,189 and EP 0 690 124. The extract included in the aerosolizable formulation of the present invention may be obtained from any of these so-described processes.

In one aspect the extract is food-grade. As will be understood by the skilled person, the term "food-grade" refers to materials which are non-toxic and safe for human consumption.

By the term "alcoholic beverage" is meant a drink or consumable liquid that contains ethanol. In one aspect the alcoholic beverage from which the extract is obtained is selected from the group consisting of wine, beer, champagne, liquor, spirit, or mixed drinks such as cocktails. In one aspect the alcoholic beverage is a liquor or spirit, e.g. rum, brandy, gin, vodka, whisky or tequila. In another aspect the alcoholic beverage is wine.

The extract obtained from an alcoholic beverage contains less than about 5% v/v ethanol. By the term "less than" is meant any amount lower than 5% v/v, including zero. In other words, the flavoring agent can be ethanol-free. The % v/v is defined with respect to the total volume of the extract.

In one aspect the extract is substantially ethanol-free. By the term "substantially" is meant trace amounts, i.e. less than 0.1% v/v ethanol, for example 0 to about 0.09% v/v ethanol. In one aspect the extract contains about 0.001 to about 0.09% v/v ethanol. In one aspect the extract contains about 0.001 to about 0.08% v/v ethanol. In one aspect the extract contains about 0.001 to about 0.07% v/v ethanol. In one aspect the extract contains about 0.001 to about 0.06% v/v ethanol. In one aspect the extract contains about 0.001 to about 0.05% v/v ethanol. In one aspect the extract contains about 0.001 to about 0.04% v/v ethanol. In one aspect the extract contains about 0.001 to about 0.03% v/v ethanol. In one aspect the extract contains about 0.001 to about 0.02% v/v ethanol. In one aspect the extract contains about 0.001 to about 0.01% v/v ethanol.

In one aspect the extract is ethanol-free. In other words, the extract contains 0% v/v ethanol. It will be understood by the skilled person in the art that levels of 0% v/v are those determined by suitably sensitive detection methods for volatile compounds.

Suitable techniques for quantifying volatile compounds such as ethanol are known in the art. One such technique is gas phase chromatography coupled with mass spectra (GC-MS). Samples can be diluted with a solvent such as dichloromethane, the internal standards for GC added, and the samples then analyzed by GC-MS using the liquid injection method. Another suitable technique is head space solid-phase microextraction (SPME)-GC analysis. Both of these techniques, including suitable solvents and standards, are known in the art and are routinely used to quantify volatile compounds, such as ethanol, in a sample.

In one aspect the flavoring agent is an extract which contains less than about 4.9% v/v ethanol. In one aspect the flavoring agent is an extract which contains less than about 4.5% v/v ethanol. In one aspect the flavoring agent is an extract which contains less than about 4.0% v/v ethanol. In one aspect the flavoring agent is an extract which contains less than about 3.5% v/v ethanol. In one aspect the flavoring agent is an extract which contains less than about 3.0% v/v ethanol. In one aspect the flavoring agent is an extract which contains less than about 2.5% v/v ethanol. In one aspect the flavoring agent is an extract which contains less than about 2.0% v/v ethanol. In one aspect the flavoring agent is an extract which contains less than about 1.5% v/v ethanol. In one aspect the flavoring agent is an extract which contains less than about 1.0% v/v ethanol. In one aspect the flavoring agent is an extract which contains less than about 0.5% v/v ethanol. In one aspect the flavoring agent is an extract which contains less than about 0.4% v/v ethanol. In one aspect the flavoring agent is an extract which contains less than about 0.3% v/v ethanol. In one aspect the flavoring agent is an extract which contains less than about 0.2% v/v ethanol. In one aspect the flavoring agent is an extract which contains less than about 0.1% v/v ethanol. In one aspect the flavoring agent is an extract which contains less than about 0.05% v/v ethanol. In one aspect the flavoring agent is an extract which contains less than about 0.01% v/v ethanol.

In one aspect the extract contains about 0.001 to about 4.9% v/v ethanol, based on the total volume of the extract. In one aspect the extract contains about 0.001 to about 4.5% v/v ethanol. In one aspect the extract contains about 0.001 to about 4.0% v/v ethanol. In one aspect the extract contains about 0.001 to about 3.5% v/v ethanol. In one aspect the extract contains about 0.001 to about 3.0% v/v ethanol. In one aspect the extract contains about 0.001 to about 2.5% v/v ethanol. In one aspect the extract contains about 0.001 to about 2.0% v/v ethanol. In one aspect the extract contains about 0.001 to about 1.5% v/v ethanol. In one aspect the extract contains about 0.001 to about 1.0% v/v ethanol. In one aspect the extract contains about 0.001 to about 0.5% v/v ethanol. In one aspect the extract contains about 0.001 to about 0.4% v/v ethanol. In one aspect the extract contains about 0.001 to about 0.3% v/v ethanol. In one aspect the extract contains about 0.001 to about 0.2% v/v ethanol. In one aspect the extract contains about 0.001 to about 0.1% v/v ethanol. In one aspect the extract contains about 0.001 to about 0.05% v/v ethanol. In one aspect the extract contains about 0.001 to about 0.01% v/v ethanol.

Whilst the flavoring agent is defined by the % v/v ethanol, the skilled person will understand that the extract may include other alcohols. In other words, the extract may include organic compounds other than ethanol in which a hydroxyl functional group is bound to a carbon, such as isobutanol or propanol.

The flavoring agent is present in any amount to deliver the desired flavor to the aerosolizable formulation. The amount of the flavoring agent is defined with respect to the total weight of the aerosolizable formulation.

In one aspect the flavoring agent is present in an amount of no greater than about 10 wt. % based on the aerosolizable formulation. In one aspect the flavoring agent is present in an amount of no greater than about 9 wt. %. In one aspect the flavoring agent is present in an amount of no greater than about 8 wt. %. In one aspect the flavoring agent is present in an amount of no greater than about 7 wt. %. In one aspect the flavoring agent is present in an amount of no greater than about 6 wt. %. In one aspect the flavoring agent is present in an amount of no greater than about 5 wt. %. In one aspect the flavoring agent is present in an amount of no greater than about 4 wt. %. In one aspect the flavoring agent is present in an amount of no greater than about 3 wt. %. In one aspect the flavoring agent is present in an amount of no greater than about 2 wt. %. In one aspect the flavoring agent is present in an amount of no greater than about 1.8 wt. %. In one aspect the flavoring agent is present in an amount of no greater than about 1.6 wt. %. In one aspect the flavoring agent is present in an amount of no greater than about 1.5 wt. %. In one aspect the flavoring agent is present in an amount of no greater than about 1.4 wt. %. In one aspect the flavoring agent is present in an amount of no greater than about 1.3 wt. %. In one aspect the flavoring agent is present in an amount of no greater than about 1.2 wt. %. In one aspect the flavoring agent is present in an amount of no greater than about 1.1. wt. %. In one aspect the flavoring agent is present in an amount of no greater than about 1.0 wt. %. In one aspect the flavoring agent is present in an amount of no greater than about 0.75 wt. %. In one aspect the flavoring agent is present in an amount of no greater than about 0.5 wt. %.

In one aspect the flavoring agent is present in an amount of at least about 0.01 wt. % based on the aerosolizable formulation. In one aspect the flavoring agent is present in an amount of at least about 0.02 wt. %. In one aspect the flavoring agent is present in an amount of at least about 0.03 wt. %. In one aspect the flavoring agent is present in an amount of at least about 0.04 wt. %. In one aspect the flavoring agent is present in an amount of at least about 0.05 wt. %. In one aspect the flavoring agent is present in an amount of at least about 0.06 wt. %. In one aspect the flavoring agent is present in an amount of at least about 0.07 wt. %. In one aspect the flavoring agent is present in an amount of at least about 0.08 wt. %. In one aspect the flavoring agent is present in an amount of at least about 0.09 wt. %. In one aspect the flavoring agent is present in an amount of at least about 0.1 wt. %. In one aspect the flavoring agent is present in an amount of at least about 0.2 wt. %. In one aspect the flavoring agent is present in an amount of at least about 0.3 wt. %. In one aspect the flavoring agent is present in an amount of at least about 0.4 wt. %. In one aspect the flavoring agent is present in an amount of at least about 0.5 wt. %. In one aspect the flavoring agent is present in an amount of at least about 0.6 wt. %. In one aspect the flavoring agent is present in an amount of at least about 0.7 wt. %. In one aspect the flavoring agent is present in an amount of at least about 0.8 wt. %. In one aspect the flavoring agent is present in an amount of at least about 0.9 wt. %.

In one aspect the flavoring agent is present in an amount of from about 0.01 to about 10 wt. % based on the aerosolizable formulation. In one aspect the flavoring agent is present in an total amount of from about 0.01 to about 9 wt. % based on the aerosolizable formulation. In one aspect the flavoring agent is present in an amount of from about 0.01 to about 8 wt. % based on the aerosolizable formulation. In one aspect the flavoring agent is present in an amount of from about 0.01 to about 7 wt. % based on the aerosolizable formulation. In one aspect the flavoring agent is present in an amount of from about 0.01 to about 6 wt. % based on the aerosolizable formulation. In one aspect the flavoring agent is present in an amount of from about 0.01 to about 5 wt. % based on the aerosolizable formulation. In one aspect the flavoring agent is present in an amount of from about 0.01 to about 4 wt. % based on the aerosolizable formulation. In one aspect the flavoring agent is present in an amount of from about 0.01 to about 3 wt. % based on the aerosolizable formulation. In one aspect the flavoring agent is present in an amount of from about 0.01 to about 2 wt. % based on the aerosolizable formulation. In one aspect the flavoring agent is present in an amount of from about 0.01 to about 1.8 wt. % based on the aerosolizable formulation. In one aspect the flavoring agent is present in an amount of from about 0.01 to about 1.6 wt. % based on the aerosolizable formulation. In one aspect the flavoring agent is present in an amount of from about 0.01 to about 1.5 wt. % based on the aerosolizable formulation. In one aspect the flavoring agent is present in an amount of from about 0.01 to about 1.4 wt. % based on the aerosolizable formulation. In one aspect the flavoring agent is present in an amount of from about 0.01 to about 1.3 wt. % based on the aerosolizable formulation. In one aspect the flavoring agent is present in an amount of from about 0.01 to about 1.2 wt. % based on the aerosolizable formulation. In one aspect the flavoring agent is present in an amount of from about 0.01 to about 1.1. wt. % based on the aerosolizable formulation. In one aspect the flavoring agent is present in an amount of from about 0.01 to about 1.0 wt. % based on the aerosolizable formulation.

In one aspect the flavoring agent is present in an amount of from about 0.01 to about 0.75 wt. % based on the aerosolizable formulation. In one aspect the flavoring agent is present in an total amount of from about 0.05 to about 0.5 wt. % based on the aerosolizable formulation. In one aspect the flavoring agent is present in an amount of from about 0.1 to about 0.4 wt. % based on the aerosolizable formulation. In one aspect the flavoring agent is present in an amount of from about 0.2 to about 0.4 wt. % based on the aerosolizable formulation. In one aspect the flavoring agent is present in an amount of from about 0.3 to about 0.4 wt. % based on the aerosolizable formulation.

In one aspect the flavoring agent is an extract which contains less than about 1% v/v ethanol and is present in the aerosolizable formulation in an amount of from about 0.01 to about 5 wt. %. In another aspect the flavoring agent is an extract which contains less than about 1% v/v ethanol and is present in the aerosolizable formulation in an amount of from about 0.01 to about 4 wt %. In another aspect the flavoring agent is an extract which contains less than about 1% v/v ethanol and is present in the aerosolizable formulation in an amount of from about 0.01 to about 3 wt %. In another aspect the flavoring agent is an extract which contains less than about 1% v/v ethanol and is present in the aerosolizable formulation in an amount of from about 0.01 to about 2 wt %. In another aspect the flavoring agent is an extract which contains less than about 1% v/v ethanol and is present in the aerosolizable formulation in an amount of from about 0.01 to about 1.8 wt %. In another aspect the flavoring agent is an extract which contains less than about 1% v/v ethanol and is present in the aerosolizable formulation in an amount of from about 0.01 to about 1.6 wt %. In another aspect the flavoring agent is an extract which contains less than about 1% v/v ethanol and is present in the aerosolizable formulation in an amount of from about 0.01 to about 1.5 wt %. In another aspect the flavoring agent is an extract which contains less than about 1% v/v ethanol and is present in the aerosolizable formulation in an amount of from about 0.01 to about 1.4 w1%. In another aspect the flavoring agent is an extract which contains less than about 1% v/v ethanol and is present in the aerosolizable formulation in an amount of from about 0.01 to about 1.3 wt %. In another aspect the flavoring agent is an extract which contains less than about 1% v/v ethanol and is present in the aerosolizable formulation in an amount of from about 0.01 to about 1.2 wt %. In another aspect the flavoring agent is an extract which contains less than about 1% v/v ethanol and is present in the aerosolizable formulation in an amount of from about 0.01 to about 1.1 wt %. In another aspect the flavoring agent is an extract which contains less than about 1% v/v ethanol and is present in the aerosolizable formulation in an amount of from about 0.01 to about 1.0 wt %.

In another aspect the flavoring agent is an extract which is ethanol-free and is present in the aerosolizable formulation in an amount of from about 0.01 to about 5 wt. %. In another aspect the flavoring agent is an extract which is ethanol-free and is present in the aerosolizable formulation in an amount of from about 0.01 to about 4 wt. %. In another aspect the flavoring agent is an extract which is ethanol-free and is present in the aerosolizable formulation in an amount of from about 0.01 to about 3 wt. %. In another aspect the flavoring agent is an extract which is ethanol-free and is present in the aerosolizable formulation in an amount of from about 0.01 to about 2 wt. %. In another aspect the flavoring agent is an extract which is ethanol-free and is present in the aerosolizable formulation in an amount of from about 0.01 to about 1.8 wt. %. In another aspect the flavoring agent is an extract which is ethanol-free and is present in the aerosolizable formulation in an amount of from about 0.01 to about 1.6 wt. %. In another aspect the flavoring agent is an extract which is ethanol-free and is present in the aerosolizable formulation in an amount of from about 0.01 to about 1.5 wt. %. In another aspect the flavoring agent is an extract which is ethanol-free and is present in the aerosolizable formulation in an amount of from about 0.01 to about 1.4 wt. %. In another aspect the flavoring agent is an extract which is ethanol-free and is present in the aerosolizable formulation in an amount of from about 0.01 to about 1.3 wt. %. In another aspect the flavoring agent is an extract which is ethanol-free and is present in the aerosolizable formulation in an amount of from about 0.01 to about 1.2 wt. %. In another aspect the flavoring agent is an extract which is ethanol-free and is present in the aerosolizable formulation in an amount of from about 0.01 to about 1.1 wt. %. In another aspect the flavoring agent is an extract which is ethanol-free and is present in the aerosolizable formulation in an amount of from about 0.01 to about 1.0 wt. %.

It will be understood by the skilled person that whilst the flavoring agent may be a multi-component flavoring agent or a single component flavoring agent, the aerosolizable formulation of the present invention can also include more than one flavoring agent which is an extract obtained from an alcoholic beverage. When the formulation includes more than one such extract, each extract can be included at the above defined amounts.

It will also be understood by the skilled person that the aerosolizable formulation of the present invention can include one or more other flavoring agents, i.e, flavoring agents which are not obtained via extraction from an alcoholic beverage.

Such flavoring agents can be selected from the group consisting of liquorice, hydrangea, Japanese white bark magnolia leaf, chamomile, fenugreek, clove, menthol, Japanese mint, aniseed, cinnamon, herb, wintergreen, cherry, berry, peach, apple, spearmint, peppermint, lavender, cardamom, celery, cascarilla, nutmeg, sandalwood, bergamot, geranium, honey essence, rose oil, vanilla, lemon oil, orange oil, cassia, caraway, cognac, jasmine, ylang-ylang, sage, fennel, piment, ginger, anise, coriander, coffee, flavor enhancers, bitterness receptor site blockers, sensorial receptor site activators or stimulators, sugars and/or sugar substitutes (e.g. sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, oil, liquid, or powder.

The aerosolizable formulation of the present invention can also include one or more imitation or synthetic alcohol flavoring agents, i.e. alcohol flavoring agents which are not obtained via extraction from an alcoholic beverage as described hereinabove, e.g. Drambuie, bourbon, scotch or whiskey flavoring agents which are not obtained via extraction from an alcoholic beverage.

In one aspect the aerosolizable formulation does not include an imitation or synthetic alcohol flavoring agent. In this aspect the only alcohol flavoring agent present in the aerosolizable formulation is the flavoring agent which is an extract obtained from an alcoholic beverage, wherein the extract contains less than about 5% v/v ethanol, as described hereinabove.

Aerosol-Forming Agents

The aerosolizable formulation of the present invention includes one or more aerosol-forming agents. An aerosol is a suspension of particles of liquid, solid, or both, within a gas. By the term "aerosol-forming agent" is meant a compound which when included in the formulation with the flavoring agent, and heated to a temperature between about 100 to about 250° C., forms a suspension of flavoring agent particles within its gaseous form. In other words, the aerosol-forming agent is involved in the formation of a suspension of the flavoring agent upon heating of the formulation.

The one or more aerosol-forming agents can be selected from the group consisting of glycerin (also called glycerine or glycerol), 1,3-propanediol, 1,2-propanediol (propylene glycol) and sugar alcohols (e.g. sorbitol, ethylene glycol, erythritol, threitol, arabitol, xylitol, ribitol, mannitol, galactitol, fucitol, iditol, inositol, volemitol, isomalt, maltitol, lactitol). In one aspect the one or more aerosol-forming agents are selected from glycerin (e.g. vegetable glycerin), 1,3-propanediol and propylene glycol.

In one aspect the aerosolizable formulation of the present invention includes two or more aerosol-forming agents.

Other Components

The aerosolizable formulation of the present invention may include one or more further components. These components may be selected depending on the nature of the formulation.

In one aspect the formulation further comprises an active agent. By "active agent" it is meant an agent which has a biological effect on a subject when the aerosol is inhaled. The one or more active agents may be selected from nicotine, botanicals, and mixtures thereof. The one or more active agents may be of synthetic or natural origin. The active could be an extract from a botanical, such as from a plant in the tobacco family. An example active is nicotine.

Thus in one aspect the present invention provides an aerosolizable formulation comprising:

(i) one or more aerosol-forming agents, (ii) a flavoring agent, wherein the flavoring agent is an extract obtained from an alcoholic beverage and wherein the extract contains less than about 5% v/v ethanol, and (iii) an active agent.

The aerosol-forming agent(s) and flavoring agent are defined hereinabove.

In one aspect the active agent is nicotine. Thus in one aspect the present invention provides an aerosolizable formulation comprising:

(i) one or more aerosol-forming agents, (ii) a flavoring agent, wherein the flavoring agent is an extract obtained from an alcoholic beverage, and wherein the extract contains less than about 5% v/v ethanol, and (iii) nicotine.

The aerosol-forming agent and flavoring agent are defined hereinabove.

Nicotine may be provided in any suitable amount depending on the desired dosage when inhaled by the user. In one aspect nicotine is present in an amount of no greater than about 6 wt % based on the total weight of the aerosolizable formulation. In one aspect nicotine is present in an amount of from about 0.4 to about 6 wt % based on the total weight of the aerosolizable formulation. In one aspect nicotine is present in an amount of from about 0.8 to about 6 wt % based on the total weight of the aerosolizable formulation. In one aspect nicotine is present in an amount of from about 1 to about 6 wt % based on the total weight of the aerosolizable formulation. In one aspect nicotine is present in an amount of from about 1.8 to about 6 wt % based on the total weight of the aerosolizable formulation.

In one aspect nicotine is present in an amount of no greater than about 5 wt % based on the total weight of the aerosolizable formulation. In one aspect nicotine is present in an amount of from about 0.4 to about 5 wt % based on the total weight of the aerosolizable formulation. In one aspect nicotine is present in an amount of from about 0.8 to about 5 wt % based on the total weight of the aerosolizable formulation. In one aspect nicotine is present in an amount of from about 1 to about 5 wt % based on the total weight of the aerosolizable formulation. In one aspect nicotine is present in an amount of from about 1.8 to about 5 wt % based on the total weight of the aerosolizable formulation.

In one aspect nicotine is present in an amount of no greater than about 4 wt % based on the total weight of the aerosolizable formulation. In one aspect nicotine is present in an amount of from about 0.4 to about 4 wt % based on the total weight of the aerosolizable formulation. In one aspect nicotine is present in an amount of from about 0.8 to about 4 wt % based on the total weight of the aerosolizable formulation. In one aspect nicotine is present in an amount of from about 1 to about 4 wt % based on the total weight of the aerosolizable formulation. In one aspect nicotine is present in an amount of from about 1.8 to about 4 wt % based on the total weight of the aerosolizable formulation.

In one aspect nicotine is present in an amount of no greater than about 3 wt % based on the total weight of the aerosolizable formulation. In one aspect nicotine is present in an amount of from about 0.4 to about 3 wt % based on the total weight of the aerosolizable formulation. In one aspect nicotine is present in an amount of from about 0.8 to about 3 wt % based on the total weight of the aerosolizable formulation. In one aspect nicotine is present in an amount of from about 1 to about 3 wt % based on the total weight of the aerosolizable formulation. In one aspect nicotine is present in an amount of from about 1.8 to about 3 wt % based on the total weight of the aerosolizable formulation.

In one aspect nicotine is present in an amount of no greater than about 1.9 wt % based on the total weight of the aerosolizable formulation. In one aspect nicotine is present in an amount of no greater than about 1.8 wt % based on the total weight of the aerosolizable formulation. In one aspect nicotine is present in an amount of from about 0.4 to about 1.9 wt % based on the total weight of the aerosolizable formulation. In one aspect nicotine is present in an amount of from about 0.4 to about 1.8 wt % based on the total weight of the aerosolizable formulation. In one aspect nicotine is present in an amount of from about 0.5 to about 1.9 wt % based on the total weight of the aerosolizable formulation. In one aspect nicotine is present in an amount of—from about 0.5 to about 1.8 wt % based on the total weight of the aerosolizable formulation. In one aspect nicotine is present in an amount of from about 0.8 to about 1.9 wt % based on the total weight of the aerosolizable formulation. In one aspect nicotine is present in an amount of from about 0.8 to about 1.8 wt % based on the total weight of the aerosolizable formulation. In one aspect nicotine is present in an amount of from about 1 to about 1.9 wt % based on the total weight of the aerosolizable formulation. In one aspect nicotine is present in an amount of from about 1 to about 1.8 wt % based on the total weight of the aerosolizable formulation.

In one aspect nicotine is present in an amount of less than about 1.9 wt % based on the total weight of the aerosolizable formulation. In one aspect nicotine is present in an amount of less than about 1.8 wt % based on the total weight of the aerosolizable formulation. In one aspect nicotine is present in an amount of from about 0.4 to less than about 1.9 wt % based on the total weight of the aerosolizable formulation. In one aspect nicotine is present in an amount of from about 0.4 to less than about 1.8 wt % based on the total weight of the aerosolizable formulation. In one aspect nicotine is present in an amount of from about 0.5 to less than about 1.9 wt % based on the total weight of the aerosolizable formulation. In one aspect nicotine is present in an amount of from about 0.5 to less than about 1.8 wt % based on the total weight of the aerosolizable formulation. In one aspect nicotine is present in an amount of from about 0.8 to less than about 1.9 wt % based on the total weight of the aerosolizable formulation. In one aspect nicotine is present in an amount of from about 0.8 to less than about 1.8 wt % based on the total weight of the aerosolizable formulation. In one aspect nicotine is present in an amount of from about 1 to less than about 1.9 wt % based on the total weight of the aerosolizable formulation. In one aspect nicotine is present in an amount of from about 1 to less than about 1.8 wt % based on the total weight of the aerosolizable formulation.

In one aspect, the aerosolizable formulation may contain one or acids. In some embodiments, the aerosolizable formulation may contain one or more acids in addition to nicotine (as the active agent). In some embodiments, the one or more acids may be one or more organic acids. In some embodiments, the one or more acids may be one or more organic acids selected from the group consisting of benzoic acid, levulinic acid, malic acid, maleic acid, fumaric acid, citric acid, lactic acid, acetic acid, succinic acid, and mixtures thereof. When included in the formulation in combination with nicotine, the one or more acids may provide a formulation in which the nicotine is at least partially in protonated (such as monoprotonated and/or diprotonated) form.

In one aspect the aerosolizable formulation includes water. The water can be distinguished from the aerosol-forming agent(s) by the concentration at which it is included in the formulation.

In one aspect the weight ratio of water to aerosol forming agent(s) is about 0:100 to about 35:65. In another aspect the weight ratio is about 0:100 to about 30:70. In another aspect the weight ratio is about 0:100 to about 28:72. In another aspect the weight ratio is about 0:100 to about 25:75. In another aspect the weight ratio is about 0:100 to about 20:80. In another aspect the weight ratio is about 0:100 to about 18:82. In another aspect the weight ratio is about 0:100 to about 15:85. In another aspect the weight ratio is about 0:100 to about 12:88. In another aspect the weight ratio is about 0:100 to about 10:90. In another aspect the weight ratio is about 0:100 to about 8:92. In another aspect the weight ratio is about 0:100 to about 5:95. In another aspect the weight ratio is about 0:100 to about 2:98. In another aspect the weight ratio is about 0:100 to about 1:99.

In one aspect the aerosolizable formulation is in the form of a liquid.

In one aspect the aerosolizable formulation is not in the form of a gel.

Process

As discussed herein, the present invention provides a process for forming an aerosol, the process comprising aerosolizing an aerosolizable formulation as defined herein.

Further Aspects

The aerosolizable formulation may be contained or delivered by any means. In one aspect the present invention provides a contained aerosolizable formulation comprising (a) a container; and (b) an aerosolizable formulation as defined herein.

The container may be any suitable container, for example to allow for the storage or delivery of the solution. In one aspect the container is configured for engagement with an electronic aerosol provision system. The container may be a bottle. The container may be configured to become fluidly in communication with an electronic aerosol provision system so that solution may be delivered to the electronic aerosol provision system. As described above, the present disclosure relates to container which may be used in an electronic aerosol provision system, such as an e-cigarette. Throughout the following description the term "e-cigarette" is used; however, this term may be used interchangeably with electronic aerosol provision system.

As discussed herein, the container of the present invention is typically provided for the delivery of aerosolizable formulation to or within an e-cigarette. The aerosolizable formulation may be held within an e-cigarette or may be sold as a separate container for subsequent use with or in an e-cigarette. As understood by one skilled in the art, e-cigarettes may aerosolizable a unit known as a detachable cartomizer which typically comprises a reservoir of aerosolizable formulation, a wick material and a device for aerosolizable the aerosolizable formulation. In some e-cigarettes, the cartomizer is part of a single-piece device and is not detachable. In one aspect the container is a cartomizer or is part of a cartomizer. In one aspect the container is not a cartomizer or part of a cartomizer and is a container, such as a tank, which may be used to deliver aerosolizable formulation to or within an e-cigarette.

In one aspect the container is part of an e-cigarette. Therefore in a further aspect the present invention provides an electronic aerosol provision system comprising: (a) an aerosolizer for aerosolizing formulation for inhalation by a user of the electronic aerosol provision system; (b) a power supply comprising a cell or battery for supplying power to the aerosolizer (c) an aerosolizable formulation as defined herein.

In addition to the aerosolizable formulation of the present invention and to systems such as containers and electronic aerosol provision systems containing the same, the present invention provides use of an extract obtained from an alcoholic beverage as a flavoring agent in an electronic provision system (e.g. an e-cigarette), wherein the extract contains less than about 5% v/v ethanol. In one aspect the extract is in an aerosolizable formulation as defined herein.

The expressions "extract obtained from an alcoholic beverage", "alcoholic beverage", and "less than" are discussed above and said disclosure is applicable to the use provided by the invention as well as the aerosolizable formulation. In one aspect the extract is substantially ethanol-free, i.e. the extract contains less than about 0.1% v/v ethanol, for example 0 to about 0.09% v/v ethanol. In another aspect the extract is ethanol free, it contains 0% v/v ethanol.

The extract may be used at any amount to deliver the desired flavor to the user of the electronic aerosol provision system. When the extract is contained in an aerosolizable formulation as defined herein, it is present in an amount with respect to the total weight of the aerosolizable formulation as defined hereinabove.

Various modifications and variations of the present invention will be apparent to those skilled in the art without departing from the scope and spirit of the invention. Although the invention has been described in connection with specific preferred embodiments, it should be understood that the invention as claimed should not be unduly limited to such specific embodiments. Indeed, various modifications of the described modes for carrying out the invention which are obvious to those skilled in chemistry or related fields are intended to be within the scope of the following claims.

The invention claimed is:

1. An aerosolizable formulation comprising:

i. one or more aerosol-forming agents; and ii. a flavoring agent, wherein the flavoring agent is an extract obtained from an alcoholic beverage, and wherein the extract contains less than 5% v/v ethanol.

2. The aerosolizable formulation according to claim 1, wherein the aerosolizable formulation is a liquid.

3. The aerosolizable formulation according to claim 1, wherein the aerosolizable formulation comprises two or more aerosol-forming agents.

4. The aerosolizable formulation according to claim 1, wherein the aerosolizable formulation comprises no greater than 1 wt % of the flavoring agent.

5. The aerosolizable formulation according to claim 1, wherein the extract contains 0.001 to 4.9% v/v ethanol.

6. The aerosolizable formulation according to claim 1, wherein the extract is ethanol-free.

7. The aerosolizable formulation according to claim 1, wherein the alcoholic beverage is liquor or wine.

8. The aerosolizable formulation according to claim 1, wherein the aerosol-forming agent is selected from the group consisting of glycerin, propylene glycol, 1,3-propanediol and a sugar alcohol.

9. The aerosolizable formulation according to claim 1, wherein the aerosolizable formulation further comprises water.

10. The aerosolizable formulation according to claim 1, wherein the aerosolizable formulation further comprises an active agent.

11. A process for forming an aerosol, the process comprising:

i. providing an aerosolizable formulation as defined in claim 1, and ii. aerosolizing the formulation.

12. A contained aerosolizable formulation comprising:

i. a container; and ii. an aerosolizable formulation as defined in claim 1.

13. An electronic aerosol provision system comprising:

i. an aerosolizer for turning a liquid into an aerosol for inhalation by a user of the electronic aerosol provision system;

ii. a power supply comprising a cell or battery for supplying power to the aerosolizer; and iii. an aerosolizable formulation as defined in claim 1.

14. A method of forming an aerosolizable formulation for an electronic aerosol provision system, the method comprising:

providing one or more aerosol-forming agents; and adding an extract obtained from an alcoholic beverage as a flavoring agent to the one or more aerosol-forming agents to form an aerosolizable formulation, wherein the extract contains less than about 5% v/v ethanol.

15. The method according to claim 14, wherein the extract contains about 0.001 to about 4.9% v/v ethanol.

16. The aerosolizable formulation according to claim 9, wherein the weight ratio of water to the one or more aerosol-forming agents is 0:100 to 35:65.

17. The aerosolizable formulation according to claim 10, wherein the active agent is nicotine.

18. The method according to claim 14, wherein the extract is substantially ethanol-free.

19. The aerosolizable formulation according to claim 1, wherein the aerosolizable formulation is capable of being used in an electronic aerosol provision system.

20. The aerosolizable formulation according to claim 14, wherein the aerosolizable formulation is a liquid and the electronic aerosol provision system comprises an aerosolizer and a power supply comprising a cell or battery for supplying power to the aerosolizer, and wherein the aerosolizer is capable of turning the liquid into an aerosol for inhalation by a user of the electronic aerosol provision system.

21. The aerosolizable formulation according to claim 1, wherein the formulation further comprises one or more acids, optionally wherein the one or more acids are one or more organic acids.

* * * * *